United States Patent [19]

Mulder

[11] Patent Number: 4,460,479

[45] Date of Patent: Jul. 17, 1984

[54] METHOD FOR POLISHING, DEBURRING AND DESCALING STAINLESS STEEL

[76] Inventor: Gerard W. Mulder, Rte. #1, Milton, Wis. 53564

[21] Appl. No.: 299,137

[22] Filed: Sep. 3, 1981

Related U.S. Application Data

[63] Continuation of Ser. No. 942,273, Sep. 14, 1978, abandoned, which is a continuation of Ser. No. 606,089, Aug. 20, 1975, abandoned.

[51] Int. Cl.[3] ..... C09K 13/06; C11D 7/08

[52] U.S. Cl. ..... 252/79.4; 134/41; 156/625; 156/903; 252/82; 252/86; 252/87; 252/142; 252/545; 252/546; 252/547

[58] Field of Search ..... 134/3, 41; 106/3; 252/142, 80, 86, 87, 148, 149, 545, 546, 547, 79.4; 156/903, 625

[56] References Cited

U.S. PATENT DOCUMENTS

| | | | |
|---|---|---|---|
| 2,631,950 | 3/1953 | Rosenfeld et al. | 134/3 |
| 2,662,814 | 12/1953 | Swihart | 252/80 X |
| 2,940,837 | 6/1960 | Acker et al. | 252/79.4 X |
| 2,940,838 | 6/1960 | Snyder et al. | 252/79.2 |
| 3,072,515 | 1/1963 | Smolinski et al. | 156/20 |
| 3,197,341 | 7/1965 | Wallace | 134/28 |
| 3,389,066 | 6/1968 | Shibasaki | 204/140.5 |
| 3,457,107 | 7/1969 | Mickelson et al. | 134/3 |
| 3,458,372 | 7/1969 | Borth et al. | 252/79.4 X |
| 3,466,192 | 9/1969 | Gardner | 134/3 |
| 3,467,599 | 9/1969 | Pugliarissi | 252/79.2 |
| 3,484,304 | 12/1969 | Beach | 148/6.15 |
| 3,496,017 | 2/1970 | Weed | 134/2 |
| 3,769,311 | 10/1973 | Armstrong et al. | 260/459 A |

FOREIGN PATENT DOCUMENTS 413227 5/1974 U.S.S.R. .

*Primary Examiner*—P. E. Willis, Jr.
*Attorney, Agent, or Firm*—Gerard W. Mulder

[57] ABSTRACT

A metal polishing composition and method using same by suspending a metal article in a hydrochloric-nitric acid solution containing an ethoxylated carboxy-containing quaternary ammonium surfactant. Addition of the present surfactant greatly improves the effectiveness of the polishing bath.

2 Claims, No Drawings

METHOD FOR POLISHING, DEBURRING AND DESCALING STAINLESS STEEL

This application is a continuation of application Ser. No. 942,273, filed Sept. 14, 1978 now abandoned, which is a continuation of Ser. No. 606,089 filed Aug. 20, 1975 now abandoned.

This invention relates to an improved concentrate for use in chemically polishing and de-burring metal articles. More particularly, the present invention provides a new polishing and de-burring composition formed of hydrochloric-nitric acid solution and containing an ethoxylated carboxy-containing quaternary ammonium surfactant.

Metal articles such as those prepared using stainless steel often require de-burring and polishing to remove surface stains and defects. Both mechanical and chemical methods have been applied to improve the appearance of the article.

Mechanical methods used in the prior art include hand de-burring, tumbling, and vibratory de-burring. Hand de-burring is expensive, slow and requires skilled personnel. In tumbling or vibratory de-burring, the articles being polished are intermingled with abrasive stone particles of sizes selected to permit the abrasive to enter valleys of the article such as gear teeth. The resultant polishing effect of tumbling or vibratory de-burring techniques is often minimal. The primary disadvantage of mechanical de-burring is that the abrasive media often lodges in the valleys of the articles requiring further cleaning. Also, mechanical de-burring is slow and costly.

Chemical polishing and de-burring has provided an effective improvement over mechanical de-burring with respect to speed of polishing and cost. However, chemical polishing techniques often prove ineffective or inconsistent.

A number of teachings are available in the prior art for metal polishing compositions. One such teaching is U.S. Pat. No. 3,072,515 wherein an aqueous solution containing about 2 to 10% by weight hydrochloric acid, 1 to 8 of nitric acid, and about 0.1 to 20% of a condensate surfactant such as isooctylphenol is disclosed for chemically polishing metals. While the teaching of this patent may work on a laboratory scale, it does not effectively nor consistently perform over extended periods in a commercially acceptable manner. Failure to effectively perform has been observed to result because of lack of uniformity in wetting the surface of the metal parts being polished.

It has now been found that by practice of the present invention, there is provided a chemically stable, highly effective metal polishing composition which more rapidly wets the metal being chemically polished and more uniformily polishes the metal surface on a commercially acceptable scale. The present invention also provides a method of using the present chemical polishing and de-burring composition. It has particular advantage in polishing stainless steel to obtain mirror like surfaces and to provide de-burring and sizing of small metal parts such as gears for clocks, punched parts and the like.

Ethoxylated carboxy-containing quaternary ammonium compounds found useful herein are disclosed in U.S. Pat. No. 3,769,311, the effective parts of which are incorporated herein by reference. These quaternary ammonium compounds have the general formula:

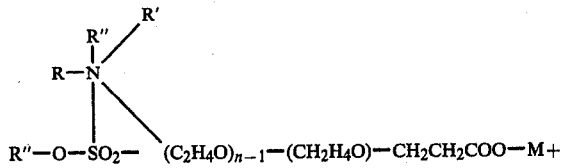

wherein:

n is an integer in the range of 1–15 inclusive,

R is a hydrocarbon radical having from 4 to 22 carbon atoms which may be either aliphatic and straight or branch chain, or cycloaliphatic, or aliphatic aromatic with the aliphatic portion being attached to an aromatic nucleus and having at least 4 carbon atoms, R′ is a radical selected from the class consisting of R groups, $(C_2H_4O)_{x-1}—C_2H_4OH$ groups and $(C_2H_4O)_{x-1}—C_2H_4O—CH_2CH_4O—CH_2CH_2COOM$ groups, M is an alkali metal or is hydrogen, R″ is a lower alkyl radical containing from 1–3 carbon atoms, and wherein, R′ contains $C_2H_4O$ groups, n−1 will be replaced by y−1, in which case, x+y will be equal to n, and n is an integer in the range of 2–15. X and y both can range from 1 to 14 depending upon the value of n. For practical purposes, x and y will both be essentially equal to n/2 subject to minor statistical variations based upon a standard distribution probability curve.

Another general type of surfactants useful herein are those having the general formula:

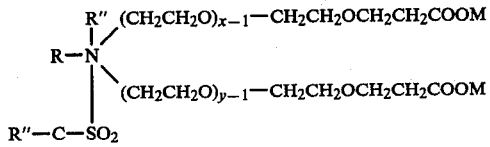

in which:

x+y equals an integer in the range of 2–15,

R″ is alkyl containing from 1–3 carbon atoms, and

M is an alkali metal.

The ethoxylated carboxy-containing quaternary ammonium compounds used in practice of the present invention are found to be chemically stable at high temperatures such as 200° F., they effectively serve as emulsifiers, produce foaming at liquid-gas interfaces, retain their stability in highly acidic solutions, and are completely soluble in the acidic solution required for polishing.

The acid bath with the present surfactant used in practice of the present invention may be formed of a mixture of hydrochloric acid and nitric acid. Desirably, an acid carrier such as sulfuric acid or phosphoric acid or mixtures thereof may be included in aqueous solutions to provide an effective means for polishing, descaling or de-burring metal articles such as those prepared using stainless steel. Desirably, the acid bath is operated at temperatures in the range of about 100° F. to about 210° F. and may vary as desired. The hot bath temperature is often about 130° F. to about 200° F. and preferably about 160° F. to about 190° F.

Also, advantageously, in starting a new bath, it is found useful to include up to about 10 grams per liter of ferric chloride which provides ferric ions which have a catalytic action on the polishing bath function. Articles of stainless steel processed using the present bath are found to consistently have a chemically clean polished, surface which is bright, smooth and possess a mirror-like finish.

The ferric chloride is accumulated in the polishing process thereafter and is not used up in the process and therefore need be added only once. If not used the solution tends to be inconsistent in polishing action.

Stainless steel articles which have been welded often have stains which are slowly removed in a polishing bath. Thus, it has been desirably found that stains at welded sections may be more effectively removed when separately treated in a preliminary treatment bath formed of an alkaline solution containing potassium permanganate. For example, a preliminary treatment bath may be one formed of about 5% to about 15% potassium permanganate, desirably about 8% to 12%; and about 10% to about 45% by weight of sodium hydroxide, desirably about 18% to 25% by weight in water. The preliminary treatment bath may be operated at temperatures above about 130° F. to about 200° F. and most typically at about 160° F. to 170° F.

Because heliarc welding stains are largely composed of Fe and FeO, the strong oxidizing preliminary treatment bath will convert this iron and iron oxide to ferric oxide or ferrous oxide which results in an increased volume which readily causes the oxidized iron to be removed in an acid bath. If desired, an intermediate acid bath such as one having about 8% to 15% by weight hydrochloric acid may be used to eliminate discoloration caused by welding.

Although not essential, stainless steel parts having oil or grease disposed thereon may be precleaned in, for example, a vapor degreaser, alkaline cleaning solution or the like. Precleaning has an advantage in the present method since it avoids overloading the polishing bath with oil in the water emulsion.

An additional advantage of the present invention is that rapid wetting of the metal being chemically polished is achieved and resultantly the surfaces are uniformly polished. This improvement is achieved by inclusion of an ethoxylated carboxy-containing quaternary ammonium surfactant capable of ionizing under low, i.e. acid pH conditions and is enhanced by the catalytic action of ferric chloride. This provides an advantage in that the cationic moiety of the surfactant molecule rapidly and uniformily attacks the metal surface thereby permitting the remaining portions of the molecule to function quickly.

The metal to be polished is suspended in a hot bath for a period of time sufficient to produce a polished article, the time being varied depending upon factors such as concentration, temperature, type of metal and the like. Normal polishing may be effected in about 5 to 20 minutes.

Metal articles usefully processed by practice of the present invention include those prepared using stainless steel, as well as various alloys of iron, chromium, and nickel along with minor constituents.

Control of the polishing may be effected by temperature, since the reaction does not begin until a temperature in excess of about 100° F. is reached.

Regardless of the pretreatment used, articles such as those formed of stainless steel may be polished and de-burred by using the following concentrate:

| Ingredient | Parts by Weight Normal | Parts by Weight Preferred |
|---|---|---|
| Hydrochloric Acid | 1–15 | 3–9 |
| Nitric Acid | 0.75–6 | 1.5–3 |
| Quaternary Ammonium Surfactant | 0.05–5 | 0.1–3 |
| Phosphoric Acid/Sulfuric Acid | 0–30 | 12–25 |
| Water | to 100 | to 100 |

Practice of the present invention will become more apparent from the following examples which are presented to illustrate practice hereof. Unless otherwise stated, all parts are given by weight.

EXAMPLE 1

Panels of 24 gauge stainless steel, Type 302, have a 2B (matte) finish were given a preliminary alkaline cleaning to remove oil, grease and the like and were then immersed in a polishing bath consisting of 8% by weight of hydrochloric acid, 2% of nitric acid, 1% of the surfactant having the formula:

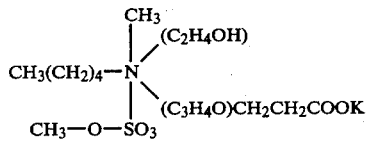

24% phosphoric acid, and the remainder water, the bath being maintained at a temperature of 190° F. After 5 minutes of immersion the panels were withdrawn, soaked in water for 2 minutes and then returned to the bath for a further 2 minutes at the end of which time they were removed, washed, rinsed and inspected. As a result of this treatment the panels acquired a bright, smooth, near-mirror finish equivalent to a No. 4 finish in appearance and additionally were completely passivated.

EXAMPLE 2

Example 1 was repeated using a bath formed of 3% hydrochloric acid and 3% nitric acid containing no surfactant additive. No brightening or polishing of the panels resulted from the treatment. In addition, non-uniform etching of the panels was observed.

EXAMPLE 3

Example 1 was repeated using a bath containing 5% hydrochloric acid, 3% nitric acid, and 1% of the same additive. Results equivalent to those of Example 1 were obtained.

EXAMPLE 4

Example 1 was repeated using 3% hydrochloric acid, 5% nitric acid, and 1% of the same additive in the bath. Equivalent results were obtained.

EXAMPLE 5

Example 1 was repeated using 3% hydrochloric acid. 3% nitric acid, 15% phosphoric acid and 1% additive surfactant of Example 1 in the bath which was maintained at 160° F. Equivalent results were obtained after a total immersion time of about 10 minutes.

EXAMPLE 6

Example 1 was repeated except 10 grams/liter of ferric chloride was added at start-up. Improved results were realized in starting and maintenance of the polishing action.

The above examples are intended to be illustrative of the present invention only and not intended to limit the invention. It will be apparent from the examples that considerable variation is possible in the method. It is also apparent that other compounds having the same general formula may be used as examples of the group with the same or similar effect. Numerous other modifications may be devised by those skilled in the art without departing from the spirit and scope of the invention.

What is claimed is:

1. The method of polishing, descaling and de-burring stainless steel, comprising the steps of (1) preparing a bath containing in combination ferric chloride, a surfactant, hydrochloric acid, and nitric acid, the surfactant being a quaternary ammonium surfactant having the formula:

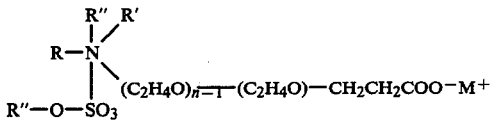

wherein:

n is an integer in the range of 1–15 inclusive;

R is a hydrocarbon radical having from 4 to 22 carbon atoms and selected from the groups consisting of a straight or branch chain aliphatic, cycloaliphatic, aliphatic aromatic with the aliphatic portion being attached to an aromatic nucleus and having at least 4 carbon atoms;

R′ is a radical selected from the class consisting of R groups, $(C_2H_4O)_{x-1}—C_2H_4O$ groups and $(C_2H_4O)_{x-1}—C_2H_4O—CH_2CH_4O—CH_2CH_2$-COOM groups;

M is an alkali metal or is hydrogen;

R″ is a lower alkyl radical containing from 1–3 carbon atoms;

where R′ contains $C_2H_4O$ groups, n−1 will be replaced by y−1, in which case x+y will be equal to n, and n is an integer in the range of 2–15, and wherein hydrochloric acid is present in an amount of about 1 to about 15 parts by weight, nitric acid is present in an amount of about 0.75 to about 6 parts by weight, the quaternary ammonium surfactant is present in an amount of about 0.05 to about 5 parts by weight, phosphoric acid or sulfuric acid is present in an amount of up to about 30 parts by weight, ferric chloride is present in an amount up to about 10 grams/liter, and the remainder to 100 parts is water, (2) maintaining the temperature between 100° F. and 210° F., and (3) immersing the stainless steel in said bath, wherein the ferric chloride acts as a catalytic agent to effect consistent polishing action thereby obtaining stainless steel of a commercially acceptable grade.

2. The method of polishing, descaling and de-burring stainless steel comprising the steps of (1) preparing a bath containing in combination ferric chloride, a surfactant, hydrochloric acid, and nitric acid, the surfactant being a quaternary ammonium surfactant having the formula:

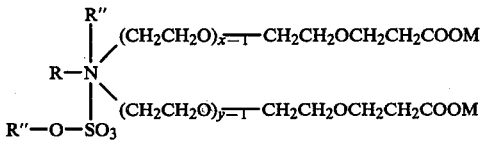

in which:

x+y equals an integer in the range of 2–15;

R″ is alkyl containing from 1–3 carbon atoms;

M is an alkali metal, and wherein hydrochloric acid is present in an amount of about 1 to about 15 parts by weight, nitric acid is present in an amount of about 0.75 to about 6 parts by weight, the quaternary ammonium surfactant is present in an amount of about 0.05 to about 5 parts by weight, phosphorus acid or sulfuric acid is present in an amount of up to about 30 parts by weight, ferric chloride is present in an amount up to about 10 grams/liter, and the remainder to 100 parts in water, (2) maintaining a temperature between 100° F. and 210° F., and (3) immersing the stainless steel in said bath, wherein the ferric chloride acts as a catalytic agent to effect consistent polishing action thereby obtaining stainless steel of commercially acceptable grade.

* * * * *